United States Patent [19]

Weyer

[11] 4,342,257

[45] Aug. 3, 1982

[54] ROTARY ACTUATOR WITH INTEGRAL FLUID COUPLING JOINT

[76] Inventor: Paul P. Weyer, 48811 284th SE., Enumclaw, Wash. 98022

[21] Appl. No.: 144,196

[22] Filed: Apr. 28, 1980

[51] Int. Cl.[3] ..... F01B 3/00

[52] U.S. Cl. ..... 92/31; 92/110; 418/186

[58] Field of Search ..... 92/2, 33, 106, 110, 92/31; 418/186

[56] References Cited

U.S. PATENT DOCUMENTS

| | | | |
|---|---|---|---|
| 3,020,012 | 2/1962 | Moracco | 91/183 A |
| 3,439,925 | 4/1969 | Sampson | 92/106 |
| 3,703,851 | 11/1972 | Ifield | 92/33 |
| 3,920,084 | 11/1975 | Russell, Jr. | 92/52 |
| 3,924,514 | 12/1975 | Parsons | 92/106 |
| 3,966,249 | 6/1976 | Lindquist | 92/2 |
| 4,005,641 | 2/1977 | Nussbaumer | 92/33 |
| 4,015,728 | 4/1977 | Barker | 92/33 |
| 4,168,654 | 9/1979 | Wilson | 92/106 |
| 4,249,451 | 2/1981 | Le Moal | 92/106 |

*Primary Examiner*—Abraham Hershkovitz
*Attorney, Agent, or Firm*—Seed, Berry, Vernon & Baynham

[57] ABSTRACT

A linearly driven rotary actuator has a tool or implement attached to the end of the output shaft. Various fluid lines are provided to drive the tool or implement as required. To prevent twisting and wrapping of fluid lines around the actuator, a rotary fluid coupling is provided as an integral part of the actuator housing.

4 Claims, 4 Drawing Figures

ROTARY ACTUATOR WITH INTEGRAL FLUID COUPLING JOINT

BACKGROUND OF THE INVENTION

1. Field of the Invention

This invention relates to linearly operated rotary actuators and, more particularly, to an integral rotary fluid coupling and a rotary actuator.

2. Prior Art

A rotary actuator provides rotational positioning for a tool or the like. The position of the output shaft of a rotary actuator is controlled by a reversible linearly movable element, which includes a fluid driven piston and single or double-helical splines or a piston-drive rack of a rack-and-pinion actuator. The rotating element, or output shaft, of a rotary actuator can advantageously rotatably position and support a hydraulic or pneumatic tool or powered implement. The fluid power and control sources for the tool are coupled to the tool from a power source remote from the tool. It is readily apparent that if fluid coupling lines are utilized, the lines may become twisted and wrap around the boom and the actuator when the tool or implement is rotated. Twisting and wrapping of the cables often limits the angular rotation of the tool.

Various types of slip joints which provide fluid coupling to rotatable equipment are known. For example, U.S. Pat. Nos. 3,908,695 and 3,966,249 disclose fluid slip couplings for tools or the like mounted at the end of a shaft. Such couplings are added externally or separate from the rotating or manipulating actuators, however, and increase the cost and particularly the length or size of the rotating actuators to the point where they are not cost effective.

SUMMARY OF THE INVENTION

It is therefore an object of this invention to provide a rotary actuator (helical, rack and pinion or vane type) in which a slip fluid coupling is provided as a part of the actuator housing for operation of tools and the like connected to the output shaft of the rotary actuator without twisting of the fluid lines to the tool.

Basically, the invention provides an output shaft which is mounted in the actuator housing and is coupled to and driven by a reversible linearly movable element. In one embodiment of the invention the driving element is a rack-and-pinion; in another embodiment of the invention this driving element is a single or double-helical spine, but the principles also apply to rotary vane actuators. A coupling block which forms part of the actuator housing and supports the conventional output shaft bearings is uniquely provided with seals and ports to also form a fluid slip joint coupling for joining the fluid source to the tool attached to the output shaft. As is well understood, the invention is described with reference to a fluid powered and controlled tool but the invention is applicable to any device requiring fluid power or control which is attached to such a rotary actuator as herein described.

DETAILED DESCRIPTION OF THE PREFERRED EMBODIMENTS

Figure 1:
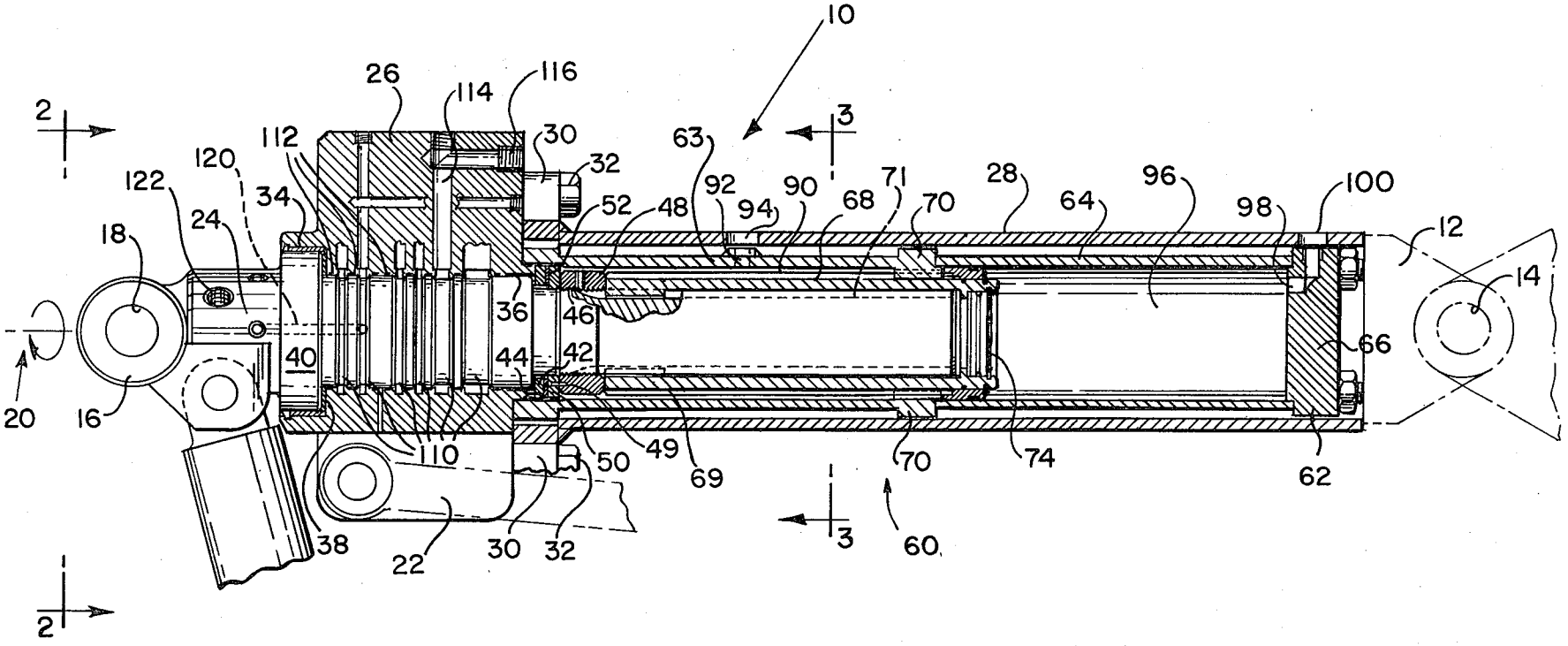
FIG. 1 is a partially sectional view of a double helical actuator embodiment of the invention.
Figure 2:
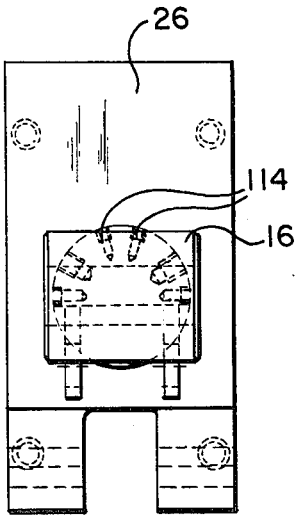
FIG. 2 is an end view of the embodiment of FIG. 1.
Figure 3:
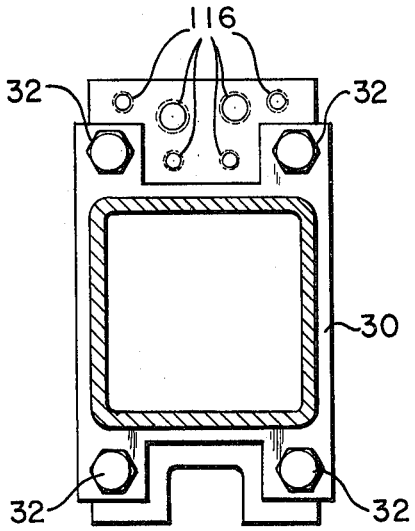
FIG. 3 is a sectional view of the embodiment of FIG. 1 taken along a section line 3—3.

One embodiment of the invention is shown in FIG. 1, in which an assembly 10 is the end segment of an articulated boom structure which, as a typical application, would be coupled to a rock drilling vehicle, such as shown in U.S. Pat. No. 3,020,012. The assembly 10 has a boom coupling 12, shown in phantom, having aperture 14 for receiving a coupling pin or the like for joining the outer boom segment 10 to another boom segment (not shown) extending from the vehicle.

At the other end of the outer boom assembly or end segment 10 is a coupling knuckle 16 having a central aperture 18 for receiving a coupling pin of a tool, implement or other utilization device (not shown) which is operated by and/or is powered by fluid, such as hydraulic fluid or air. Movement of the outer boom assembly 10 with respect to the inner boom is accomplished, for example, by means of a hydraulically operated cylinder 22 pinned to the boom assembly 10.

In using the tool, it is often necessary to rotate the tool about an axis 20 which extends longitudinally along the outer boom assembly as shown. The tool is attached to an output shaft 24 which is journaled in an actuator housing which includes a coupling block 26, a tube 63 and an actuator cylinder 64, which in the embodiment shown is housed within an elongated rectangular hollow boom member 28. The rectangular hollow boom member 28 has an outwardly extending flange 30 welded to one end, which flange is fastened to the coupling block 26 by bolts 32. The output shaft 24 is journaled in a longitudinally extending central bore in the coupling block aligned along the axis 20. Bushings 34, 36 and 38 support the output shaft 24. At the other end of the bore formed in the coupling block 26, a spacer ring 42 is coupled to the block by a pin 44. The output shaft 24 is connected to a threaded ring 48 which is coupled to a ring 50 by pins 49. A thrust bearing 52 is contained between the rings 42, 50. The shaft 24 is thus rotatably and axially supported within the coupling block 26.

The rotary actuator portion 60 of the boom assembly 10 includes an actuator cylinder 64 and tube 63 provided with a flange 30 which is bolted to coupling block 26. The end of the cylinder 64 is sealed with a cap 66 and the cylinder and tube are held by the rods 62. A cylindrical piston sleeve 68 is reciprocably mounted within tube 63. Helical spines are formed on the exterior surface of the sleeve 68, which splines engage a helically splined ring 70 formed on the tube 63. A second helically splined ring 69 on the interior of the sleeve 68 meshes with helical splines 71 on the exterior surface of the output shaft. The outermost end of the piston sleeve 68 has a piston 74 as is conventional.

The output shaft 24 is rotated in one direction by pressurized fluid entering the chamber 90 through a port 92 and a port 94 formed through the wall of the rectangular boom member 28. Fluid pressure in the chamber 90 causes the sleeve 68 to move away from the coupling block 26 toward the end cap 66 as shown in FIG. 1. Longitudinal movement of the sleeve 68 along the axis 20 causes the respectively engaging helical splines to rotate the output shaft 24. Rotation of the output shaft 24 in the opposite direction occurs when fluid is introduced via ports 98 and 100 into chamber 96.

Fluid connections are provided between a tool or implement attached to the coupling knuckle 16 at the end of the helical actuator output shaft 24 and an integral rotary fluid coupling formed as a part of the rotary actuator housing, including the tube 63 and the coupling block 26. A series of annular grooves 110 are formed around the circumference of the midportion of the output shaft 24. The grooves are separated by a series of seal rings 112 (only a few indicated) which are positioned in circumferential annular grooves formed in the walls of the coupling block 26. A series of radial bores 114 (only a few shown in FIG. 1 for clarity) extend through the coupling block 26 to the grooves 110. A series of longitudinally extending bores 116 (also only a few shown) intersect the radial bores 114 and provide fluid conduits through the coupling block 26 and the grooves 110. A series of longitudinally extending bores 120 are formed in the output shaft 24 parallel to the axis 20 and communicate with corresponding ones of a series of radial bores 122 connecting the radial bores with respective grooves 110. The conduits formed in the coupling block 26 and the chambers formed by the grooves 110 in the output shaft 24 and the conduits formed in the end of the output shaft 24 provide an integral rotary fluid coupling so that an operating fluid or control fluid for the tool connected at the end of the output shaft 24 is provided with fluid connections without twisting and wrapping of fluid lines around the outer boom assembly 10.

Figure 4:
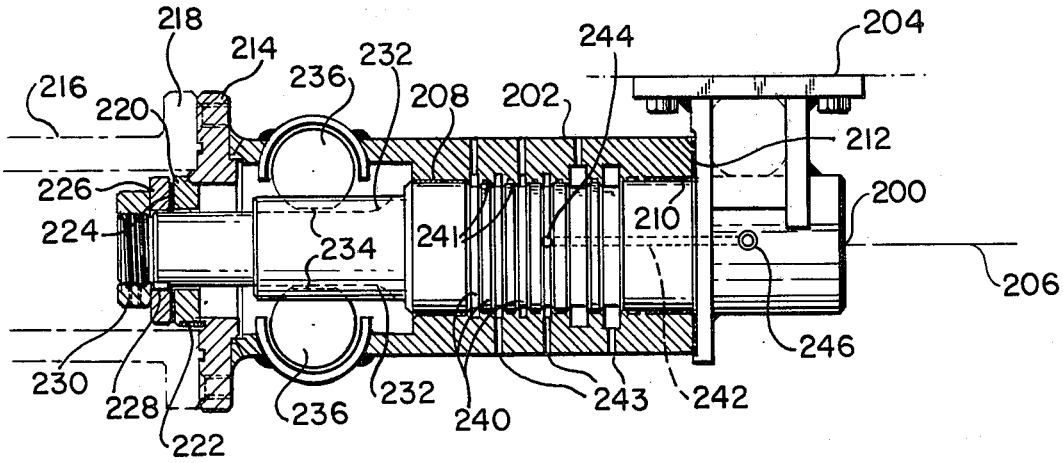
FIG. 4 is a partially sectional view of a rack-and-pinion embodiment of the invention.

FIG. 4 shows another embodiment of the invention. This embodiment utilizes rack-and-pinion arrangement for linearly driving a rotatable output shaft 200 which is journaled within a housing 202. A bracket 204 for a tool or the like is welded to the shaft 200. the shaft 200 is rotatable within a central bore formed in the housing 202 along an axis 206. The housing 202 has bushings 208, 210 and a thrust bearing 212 for radially and axially supporting the shaft 200. The housing 202 is welded to a flange 214. A flange 218 at the end of a boom segment 216 is fastened to the housing flange 214 by suitable means, such as bolts or the like. The end of the shaft 200 extends into the boom end and is supported on the flange 214 by a ring 220 which is fixed with a pin 222. A thrust bearing 224 is sandwiched between the ring 220 and a bearing support ring 226 which is fixed with a pin 228 and held in position on a threaded end portion of the shaft 200 by a nut 230. The midportion of the shaft 200 has circumferential gear teeth 232, which are engaged by the teeth 234 of a pair of linearly movable racks 236 which are actuated by hydraulic cylinders as is well known.

A series of annular grooves 240 are formed in the circumferential surface of a midportion of the shaft 200 as shown in FIG. 4. The grooves are separated by seal rings 241 contained in grooves formed in the walls of the housing 202. A series of bores 243 are formed through the housing 202 to communicate with the grooves 240. Appropriate hydraulic fluid hoses are coupled to the bores 241 extending from the boom 216 for power and control of the tool. A series of longitudinally extending bores 242 are formed in the shaft 200, each of which communicates with a radial bore 244 formed to connect to one of the grooves 240. The other end of each of the longitudinal bores 242 connects to one of a series of bores 246 at the outside end of the shaft 200. The hydraulic fluid lins from the tool then connect to the bores 246. As the racks 236 are linearly moved, the shaft 200 is rotated and an integral slip fluid coupling is obtained for the power and control fluid between the tool and the boom without twisting or wrapping of fluid lines.

While particular embodiments of the invention have been shown and described, it should be understood that the invention is not limited thereto since many modifications may be made. It is therefore contemplated to cover by the present application any and all such modifications which fall within the true spirit and scope of the basic underlying principles disclosed and claimed herein.

I claim:

1. In a boom assembly having a rotary actuator for rotating a fluid operated tool or other device and an integral rotary fluid coupling for said actuator, comprising:

an actuator housing fastened to one of said boom or tool and having an axial bore formed therein, an output shaft of said rotary actuator fastened to the other of said boom or tool and rotatably mounted within said bore;

drive means coupled to said shaft within said housing for rotating said shaft to rotate said tool relative to said boom;

said housing including a combined fluid slip coupling and shaft bearing mount having a plurality of sealed fluid chambers formed between said actuator housing and said rotatable output shaft, said fluid slip coupling and bearing mount also including shaft bearings for axially and radially supporting the output shaft in said housing, said bearings being located on opposite sides of said sealed fluid chambers;

first fluid ports formed in said slip coupling and bearing mount for connection to said fluid chambers and adapted to be connected to a fluid pressure source;

second fluid ports formed in said output shaft for connection to said chambers and adapted to be connected to a fluid operated device connected to said shaft whereby the fluid operated device is provided with fluid without twisting of fluid lines.

2. The invention of claim 1, wherein said output shaft includes helical splines and said means for rotating said shaft includes a linearly movable fluid driven piston sleeve.

3. The invention of claim 1, wherein said shaft is part of a rack-and-pinion actuator and said housing includes hydraulic cylinders and said means for rotating said shaft includes linearly movable fluid-driven racks for rotating said output shaft.

4. The invention of claim 1, wherein said sealed chambers include circumferential annular grooves formed between said shaft and said housing and including seal rings separating said grooves and providing fluid sealing for said chamber as the shaft is rotated by said rotary actuator.

* * * * *